US005425513A

United States Patent [19]

Shainker

[11] Patent Number: 5,425,513

[45] Date of Patent: Jun. 20, 1995

[54] BAG DISPENSER PACKAGE

[75] Inventor: Arnold N. Shainker, Andover, Mass.

[73] Assignee: Webster Industries, Peabody, Mass.

[21] Appl. No.: 41,751

[22] Filed: Apr. 2, 1993

[51] Int. Cl.[6] ..... B65H 23/00

[52] U.S. Cl. ..... 242/595; 383/8; 206/390

[58] Field of Search ..... 242/55, 55.2, 55.53, 242/132, 137, 146, 588.3, 590, 595; 206/554, 390, 391; 383/8, 37, 38; 221/63, 64, 65; 220/407

[56] References Cited

U.S. PATENT DOCUMENTS

| | | | |
|---|---|---|---|
| 3,381,817 | 5/1968 | Harm | 206/391 |
| 3,718,253 | 2/1973 | Smith | 221/63 X |
| 4,807,754 | 2/1989 | Rowe | 383/8 X |
| 4,860,893 | 8/1989 | Kaufman | 206/390 |
| 4,911,560 | 3/1990 | Hoover et al. | 383/8 |
| 5,096,305 | 3/1992 | Rimondi et al. | 383/8 X |
| 5,170,957 | 12/1992 | Carpenter | 242/55.53 |
| 5,186,099 | 2/1993 | Qing et al. | 242/55.2 X |

FOREIGN PATENT DOCUMENTS

| | | | |
|---|---|---|---|
| 0300357 | 1/1989 | European Pat. Off. | 242/55.2 |

*Primary Examiner*—Daniel P. Stodola
*Assistant Examiner*—Jolin P. Darling
*Attorney, Agent, or Firm*—Wolf, Greenfield & Sacks

[57] ABSTRACT

A trash bag dispensing package including a T-shirt bag having a roll of continuous plastic bags. When the leading bag is being pulled from the roll and out the mouth of the T-shirt bag, the roll rotates within the T-shirt bag in an arrangement which provides controlled dispensing of the trash bags. The T-shirt bag may be conveniently hung by its handles from virtually any type of support.

21 Claims, 4 Drawing Sheets

BAG DISPENSER PACKAGE

BACKGROUND OF THE INVENTION

1. Field of the Invention

This invention relates to a new and improved method for dispensing plastic bags and, in particular, dispensing large plastic bags from a compact, conveniently suspendable dispensing package.

2. Background of the Invention

Plastic bags are used in large numbers in a wide variety of applications. For example, cleaning personnel often require dozens of plastic trash bags on a single route through offices, hotel rooms, hospitals and other large buildings. The use of plastic bags, however, is not limited to collecting trash. Shoppers, for example, use large numbers of bags to package various types of produce and other items which often must be individually weighed or stored separately.

When bags are used in large numbers, compact storage and easy access provides the best possible scenario. Often, cleaning personnel will pile folded plastic bags on carts for access during the day. However, space on these carts can be very limited. Plastic trash bags laid flat require a substantial amount of room which may not be available on a cart because of other essential items. Sometimes a box is used to hold the trash bags, but the box takes up valuable room on the cart and is not convenient to carry.

Rolls of plastic bags can be found in grocery stores where the rolls are suspended by rods in the produce or other sections of the store. The shoppers tear bags from the roll along perforated tear lines. One inconvenience, however, is that the rods require special mounting fixtures and a large surface area.

SUMMARY OF THE INVENTION

The principal object of the present invention is to provide a bag dispensing package which may be easily hung from a rod or hook while simultaneously providing easy access to the plastic bags housed within.

Another object of the present invention is to provide a dispensing package which is cheap and simple to make, and readily disposable when the plastic bags run out.

A further object of the present invention is to provide a dispensing package which is easily portable and may be readily transferred from one cart or hook to another.

To accomplish these and other objects, the bag dispensing package of this invention includes a continuous roll of plastic film bags with the bags serially related in an interleafed arrangement or connected along perforated tear lines and a single T-shirt bag having a handle and an opening to its interior and containing the roll of bags enabling the roll of bags to turn as the leading bag in the roll is drawn out the opening while the T-shirt bag is suspended by the handle.

These and other objects and features of the present invention will be better understood and appreciated from the following detailed description of one embodiment thereof, selected for the purpose of illustration and shown in the accompanying drawings, in which:

DETAILED DESCRIPTION OF THE PREFERRED EMBODIMENT

Figure 1:
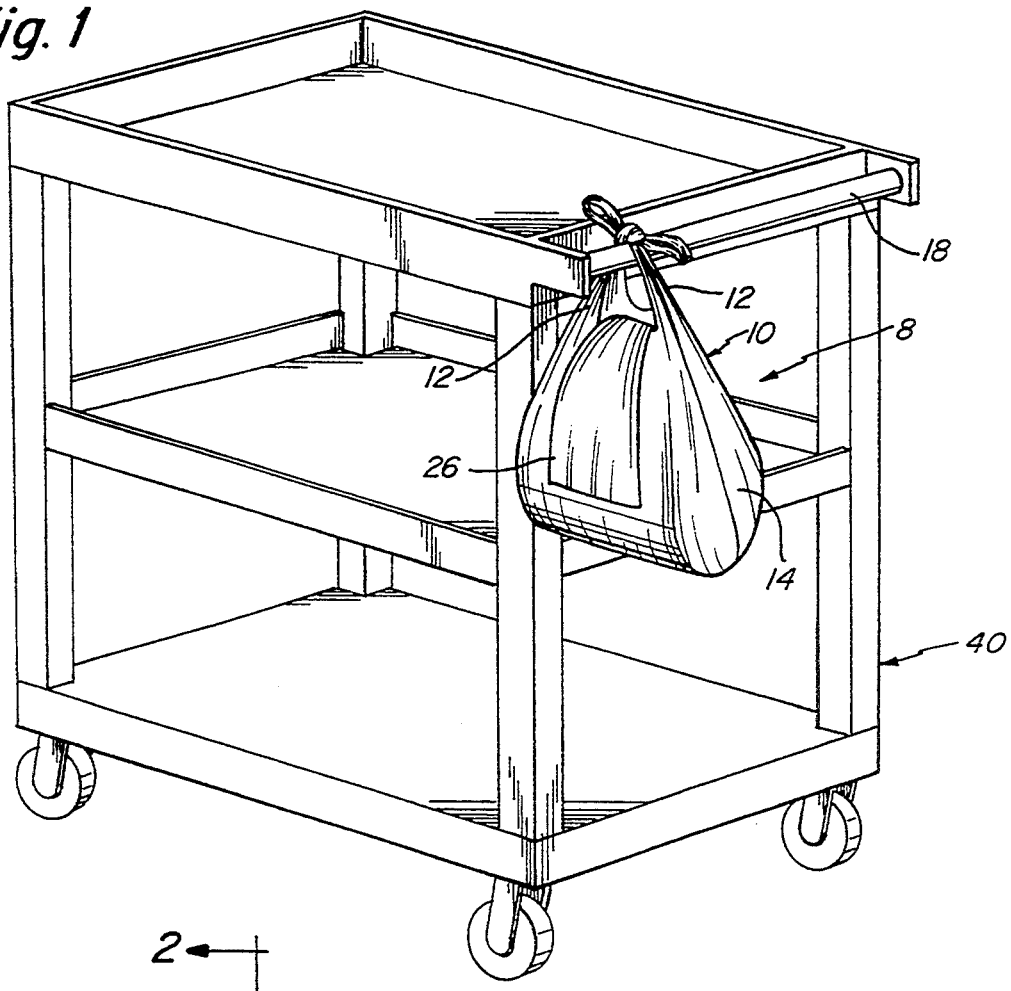
FIG. 1 is a perspective view showing the present invention suspended from a cart.

The overall arrangement and function of the dispensing package 8 may best be seen in FIGS. 2–4 and 7. The package 8 comprises a T-shirt dispensing bag 10 housing a continuous roll of plastic bags 20 or the like. The T-shirt dispensing bag 10 has a pair of handles 12 extending upwardly from a body portion 14. The dispensing bag 10 is preferably made of a lightweight plastic film such as high molecular weight high density polyethylene which is strong enough to support the roll 20 without tearing or rupturing. While a T-shirt bag 10 is preferred, other styles of bags may be used. The advantages of a T-shirt bag 10 is, however, that it may be hung from a hook 16 without having to tie the handles together or to the support on which it is to be suspended, and when the bag is to be suspended from a bar as shown at 18 in FIG. 1, the handles 12 may readily be tied together about the bar. Also, the handles 12 make the package 8 convenient to carry.

Figure 2:
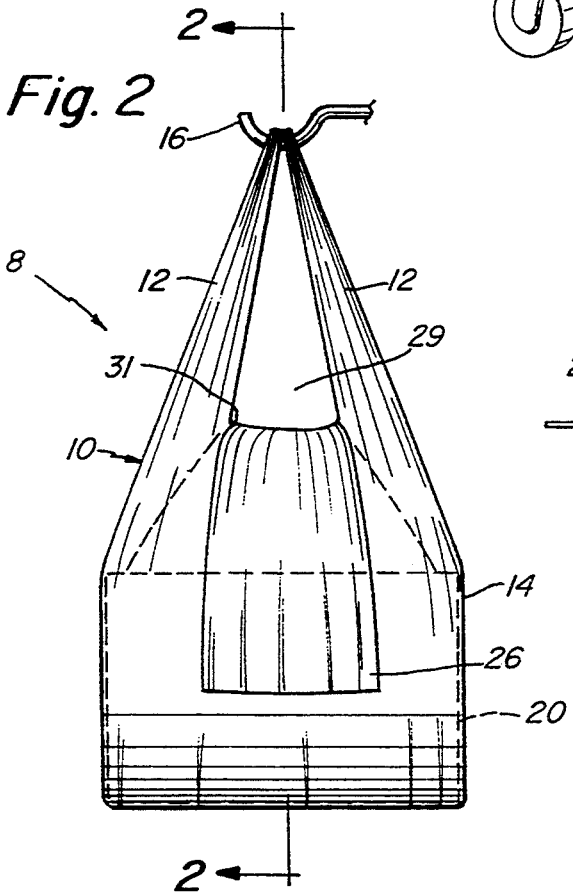
FIG. 2 is a front elevational view of the present invention suspended from a hook.
Figure 4:
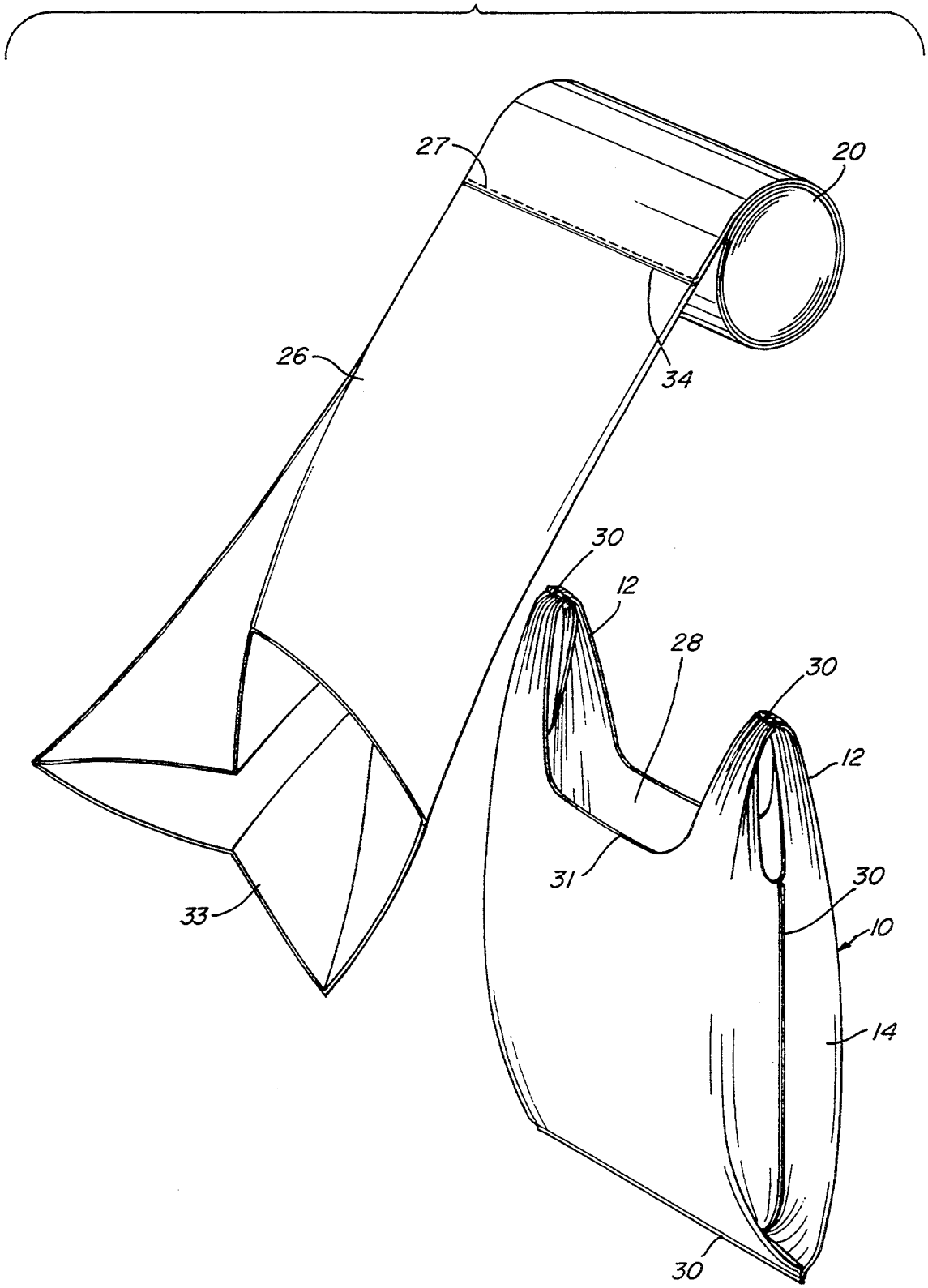
FIG. 4 is an exploded perspective view of the roll of plastic bags connected along perforated tear lines and the T-shirt bag of the present invention.
Figure 7:
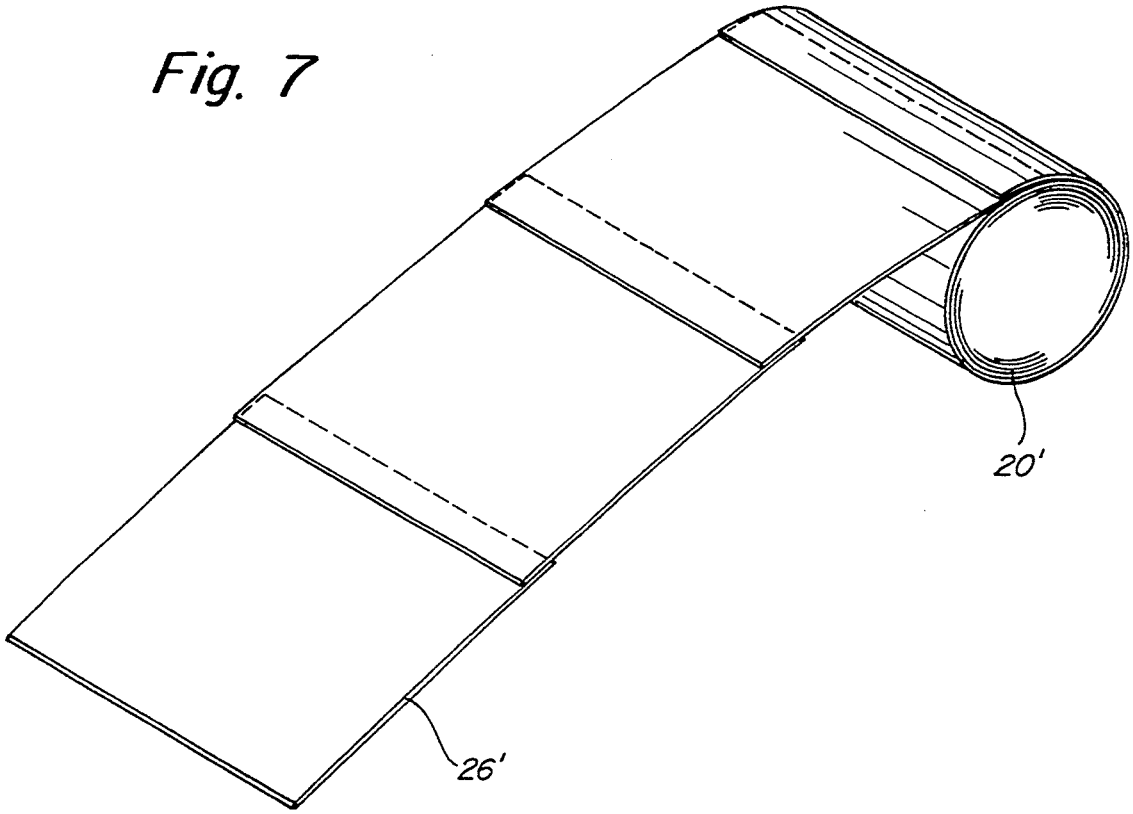
FIG. 7 is a perspective view of a partially unrolled roll of plastic bags in an interleafed arrangement.

The roll of plastic bags 20, having each bag serially related, sits on the bottom of the body portion 14 of the dispensing bag 10. A leading bag 26 on the roll 20, that is, the next bag to be torn or pulled from the roll 20, extends out of the mouth 28 of the body portion 14 and drapes over an upper edge 31 of the body portion 14 and down along a face of the T-shirt bag 10 as shown in FIGS. 1 and 2. Each bag on the roll 20 is separated from its immediate neighboring bags on the roll 20 by tear lines 27, if perforated rolls are used (FIG. 4). If an interleafed arrangement is used, the neighboring bags on the roll 20 overlap with one another as seen in FIG. 7. The leading bag 26' extends below its following neighboring bag as shown in phantom. FIG. 7 shows the roll partially unrolled, however, once the leading bag 26' is no longer urged against the body of the roll 20', it is free for use.

It is preferable that the continuous roll 20 have a length substantially similar to the width of the dispensing bag 10 (see FIG. 2). This arrangement provides resistance to lateral motion of the leading bag 26 when it is being torn or pulled from the roll 20 along the tear line 27. If the bag 10 had a body portion width shorter that the roll 20, there could be too much resistance due to the tight fit of the body portion 14 on the roll 20 and the bag 10 would likely rupture or tear and the leading bag 26 on the roll 20 would separate from the roll 20 before it was fully withdrawn so as to leave the new leading bag of the roll 20 within the dispensing bag 10. On the other hand, if the width of the body portion 14 were substantially greater than the roll 20, rotation of the roll 20 would not be as controlled as in the preferred relationship. The roll 20 would tend to bounce around in the bag 10 as the leading bag 26 was being pulled off.

Furthermore, the roll 20 could spin or slip sideways causing the leading bag 26 or subsequent bags to become twisted.

When both handles 12 are suspended from the same point of a support, a triangular opening 29 is defined by the handles 12 and the upper edge 31 of the body portion 14 (see FIG. 2). The opening 29 acts as a collar on the leading bag so that the leading bag will not fall back into the T-shirt bag 10 or become entangled with the handles 12.

Figure 3:
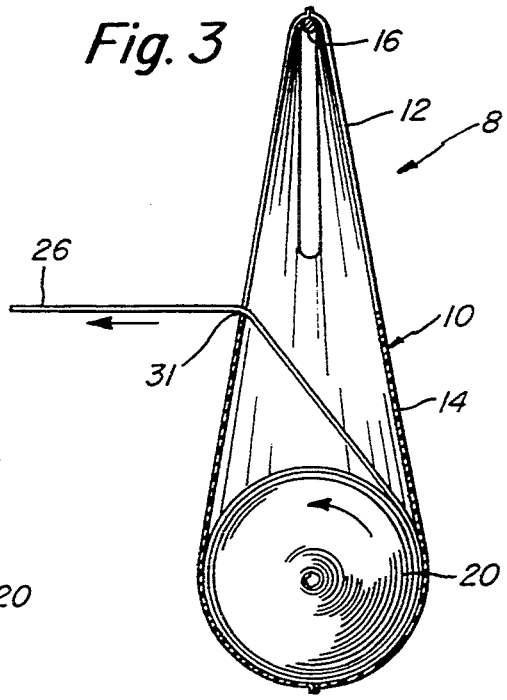
FIG. 3 is a cross-sectional view of the present invention taken along the section line 3—3 of FIG. 2.

When the leading bag 26 is pulled outward as shown in FIG. 3, the roll 20 easily rotates within the dispensing bag 10. The friction between the roll 20 and the bag 10 and between the leading bag 26 and the upper edge 31 is sufficient to prevent the user from unintentionally withdrawing more bags than desired from within the body portion 14.

The roll 20 may be composed of gusseted or plain unexpandable bags as desired. As shown in FIG. 4, the trash bags are gusseted lengthwise so as to have an expandable width several times the width of the dispenser 10. This arrangement provides a compact dispensing T-shirt bag 10 for a roll of large size trash bags. For example, the trash bags shown are approximately 3 feet long, 2.5 feet wide at the opening 33 when completely expanded, and 8 inches wide at the base 34. When filled, the bag assumes a U-shaped cross-section. The roll 20 has a width of 8 inches, the same as the base 34 of the bag and an diameter of 5 inches before any bags are torn from the roll 20. Conventional manufacturing and folding techniques may be used to form the roll 20. The same gusseting or folding is available in the interleafed arrangement of FIG. 7.

Figure 5:
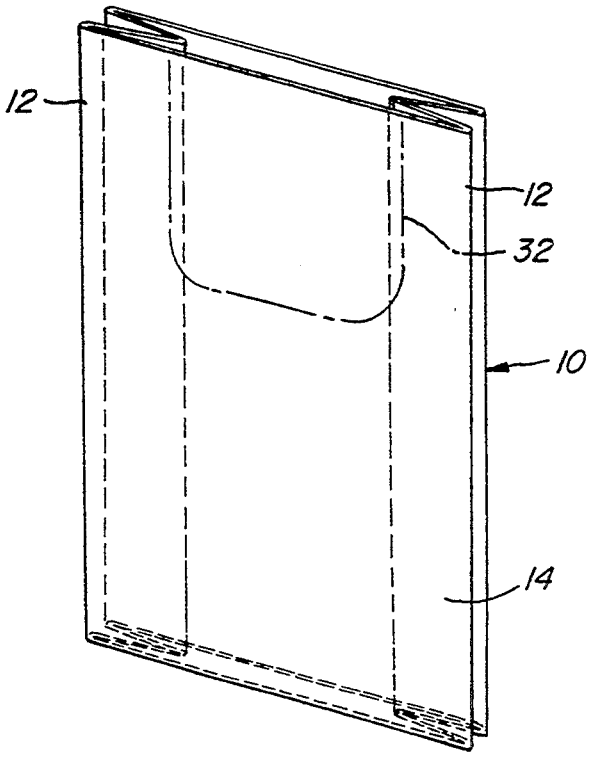
FIG. 5 is a perspective view of the T-shirt bag prior to heat sealing.

The T-shirt bag 10, as seen in FIG. 4, has heat sealed seams 30 on the handles 12 and the sides and bottom of the body portion 14. The T-shirt bag 10, prior to sealing is shown in FIG. 5, is cut along dotted lines 32 from the handles 12 and mouth 28 of the bag. The T-shirt bag may be made in different methods known in the bag manufacturing art.

FIG. 1 and FIG. 2 illustrate two ways of using the dispenser 10, namely, in conjunction with a cart 40 or a wall hook 16. Many other ways of using the invention exist, however. For example, the dispenser bag may be secured to a shopping cart or the handle of a garbage can for the convenience of the user.

Figure 6:
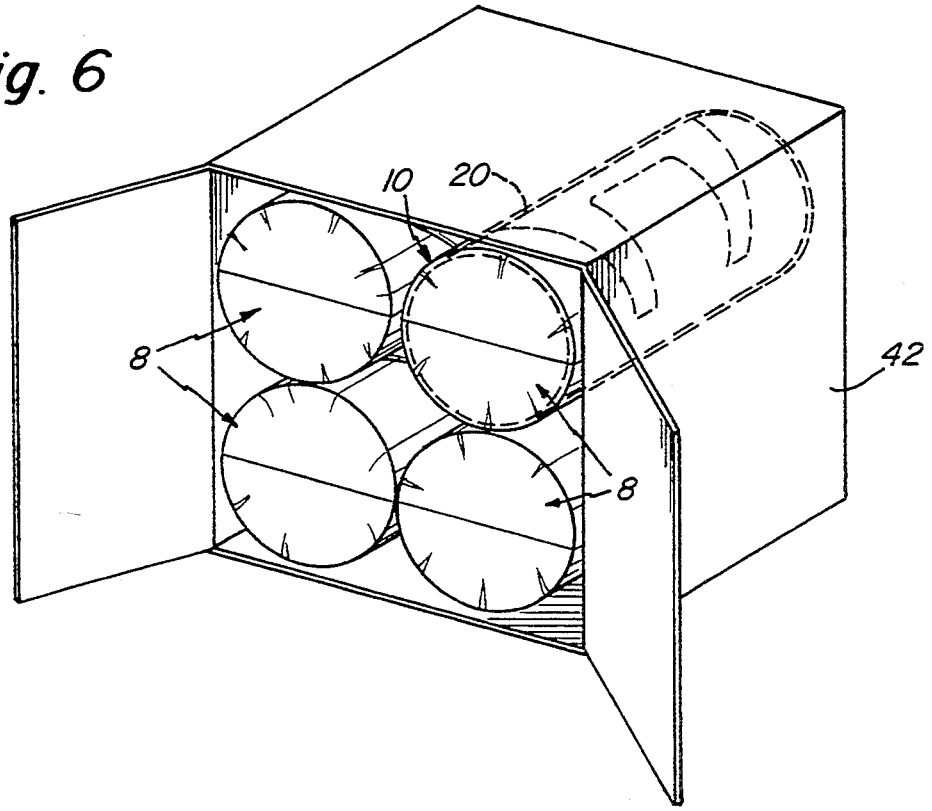
FIG. 6 is a box including multiple bag dispensing packages.

Shipment of the dispensing packages 8 may be done in a box arrangement. FIG. 6 shows four dispensing packages 8 tightly secured within a box 42 for shipping. Any number of packages 8 may be sent in an appropriately sized box 42.

Various changes and modifications and equivalents of the embodiment described above and shown in the drawings may be made within the scope of this invention. It is intended that all matters contained in the above description or shown in the accompanying drawings are presented by way of example only and are intended to be interpreted in an illustrative and not limiting sense.

What is claimed is:

1. A dispensing package of bags, comprising:

a continuous roll of bags serially related, said roll having a length, a diameter, and a leading bag;

a single T-shirt bag having a handle and an opening to its interior and containing the roll of bags enabling the roll of bags to turn about its length as the leading bag in the roll is drawn out of the bag through the opening as the T-shirt bag is suspended by the handle; and wherein the T-shirt bag has a width sufficient to allow the roll of bags contained in it to lie along its length against the bottom of the T-shirt bag and to permit the roll to rotate in the T-shirt bag while the roll remains on the bottom of said bag.

2. A dispensing package as set forth in claim 1, wherein the bags of said continuous roll of bags are connected by tear lines.

3. A dispensing package as set forth in claim 2, wherein said roll length is substantially equal to the width of the T-shirt bag.

4. A dispensing package as set forth in claim 3, wherein said leading bag has an opening width larger than said roll width.

5. A dispensing package as set forth in claim 1, wherein the bags of said continuous roll of bags are interleafed.

6. A dispensing package as set forth in claim 5, wherein said roll length is substantially equal to the width of the T-shirt bag.

7. A dispensing package as set forth in claim 6, wherein said leading bag has an opening width larger than said roll width.

8. A dispensing package for bags, comprising:

a roll of bags serially related, said roll having a leading bag; and a disposable dispensing bag having an open mouth and containing the roll and having a pair of handles for hand carrying the dispensing bag and for suspending it from a support with the leading bag on the roll extending out the open mouth of the bag, said roll being rotatable along its length against the bottom of the dispensing bag whereby the leading bag may be torn from the roll as the next bag in the roll is drawn out the mouth of the dispensing bag.

9. A dispensing package as set forth in claim 8, wherein the bags of said roll of bags are connected in series by tear lines.

10. A dispensing package as set forth in claim 9, wherein said roll has a length substantially equal to the width of the dispensing bag.

11. A dispensing package as set forth in claim 10, wherein said leading bag has an opening width larger than said roll width.

12. A dispensing package as set forth in claim 8, wherein the bags of said roll of bags are in an interleafed arrangement.

13. A dispensing package as set forth in claim 12, wherein said roll has a length substantially equal to the width of the dispensing bag.

14. A dispensing package as set forth in claim 13, wherein said leading bag has an opening width larger than said roll width.

15. A package of bags and a plurality of disposable dispensers for the bags, comprising:

a plurality of separate rolls of plastic bags with the bags in each roll separable from the other bags in the roll by a tear line, so that the outermost bag in a roll may readily be torn from the roll;

a separate disposable, dispensing bag for each roll, each dispensing bag having an opening therein and each containing a roll of the bags, said opening in each dispensing bag being sufficiently large to permit the outermost bag in the roll contained therein to be unrolled from the roll and drawn from the dispensing bag while the roll remains along its length against the bottom of the dispensing bag;

means forming part of each dispensing bag for partially closing the opening so as to prevent the roll in the dispensing bag from being drawn from or falling through the opening and for securing the dispensing bag to a support; and a master container housing the plurality of dispensing bags each containing a roll of bags.

16. A package as defined in claim 15, wherein the dispensing bags are T-shirt bags.

17. A package for bags and a plurality of disposable dispensers for the bags, comprising:

a plurality of separate rolls of bags with the bags in each roll separate and interleafed with the other bags in the roll so that the outermost bags in a roll may readily be pulled from the roll;

a separate disposable, dispensing bag for each roll, each dispensing bag having an opening therein and each containing a roll of the bags, said opening in each dispensing bag being sufficiently large to permit the outermost bag in the roll contained therein to be unrolled from the roll and drawn from the dispensing bag while the roll remains along its length against the bottom of the dispensing bag;

means forming part of each dispensing bag for partially closing the opening so as to prevent the roll in the dispensing bag from being drawn from or falling through the opening and for securing the dispensing bag to a support; and a master container housing the plurality of dispensing bags each containing a roll of bags.

18. A package as defined in claim 17, wherein the dispensing bags are T-shirt bags.

19. A system for dispensing bags comprising:

a containing bag having means for being suspended;

a continuous roll of bags, serially related, said roll having a leading bag and a shape defined by a length and a diameter; and said containing bag having an area for supporting said roll along its length during rotation about its length such that said area continually conforms to said shape of said roll as bags are torn therefrom.

20. A system as set forth in claim 19, wherein said containing bag has a width and a depth such that said depth decreases as the diameter of the roll decreases.

21. A system as set forth in claim 20, wherein said containing bag width is substantially equal to said roll length.

* * * * *